US008408284B2

(12) United States Patent
Polisoto et al.

(10) Patent No.: US 8,408,284 B2
(45) Date of Patent: Apr. 2, 2013

(54) HEAT EXCHANGER ASSEMBLY

(75) Inventors: David M. Polisoto, East Amherst, NY (US); Donald R. Pautler, Lockport, NY (US); Douglas C. Wintersteen, Burt, NY (US); Richard V. Cooper, Jr., Lockport, NY (US); David E. Samuelson, Wheatfield, NY (US)

(73) Assignee: Delphi Technologies, Inc., Troy, MI (US)

( * ) Notice: Subject to any disclaimer, the term of this patent is extended or adjusted under 35 U.S.C. 154(b) by 56 days.

(21) Appl. No.: 13/101,470

(22) Filed: May 5, 2011

(65) Prior Publication Data

US 2012/0279692 A1 Nov. 8, 2012

(51) Int. Cl.
*F28F 9/02* (2006.01)
*F28F 9/04* (2006.01)

(52) U.S. Cl. ..... 165/174; 165/178

(58) Field of Classification Search ..... 165/174, 165/175, 176, 178, 153
See application file for complete search history.

(56) References Cited

U.S. PATENT DOCUMENTS 1,662,236 A * 3/1928 Coupland ..... 165/174
1,684,083 A * 9/1928 Bloom ..... 62/525
3,976,128 A * 8/1976 Patel et al. ..... 165/153
5,094,293 A * 3/1992 Shinmura ..... 165/178
5,186,248 A 2/1993 Halstead
6,729,386 B1 * 5/2004 Sather ..... 165/110
2002/0174978 A1 * 11/2002 Beddome et al. ..... 165/174
2006/0102331 A1 * 5/2006 Taras et al. ..... 165/174
2007/0039724 A1 * 2/2007 Trumbower et al. ..... 165/174
2008/0023183 A1 * 1/2008 Beamer et al. ..... 165/174
2008/0023186 A1 * 1/2008 Beamer et al. ..... 165/174
2008/0093051 A1 * 4/2008 Rios et al. ..... 165/61
2009/0173482 A1 7/2009 Beamer et al.
2009/0173483 A1 7/2009 Beamer et al.
2009/0229805 A1 9/2009 Beamer et al.

* cited by examiner

*Primary Examiner* — Tho V Duong
(74) *Attorney, Agent, or Firm* — Thomas N. Twomey

(57) ABSTRACT

A heat exchanger assembly that includes an outlet header/manifold defining an outlet cavity, an outlet tube in fluidic communication with the outlet cavity, and a heat exchanger core. The outlet tube and the outlet cavity cooperate to reduce a temperature value range across the heat exchanger core by equalizing refrigerant distribution between the refrigerant tubes within the heat exchanger core. The length of the heat exchanger headers/manifolds may be increased for a predetermined packaging width because the outlet tube and inlet conduit may exit the headers/manifolds perpendicularly rather than axially, allowing the heat exchanger core width to be increased. The increased heat exchanger core width allows additional refrigerant tubes to be included in the heat exchanger core, providing decreased air pressure difference for air flowing through the heat exchanger assembly and increased heat capacity of the heat exchanger assembly.

6 Claims, 10 Drawing Sheets

| TEST OPERATING CONDITIONS | | TEST 1 | TEST 1 | TEST 1 |
|---|---|---|---|---|
| REQT. AIR MASS FLOW (WET) | kg/min | 35.8 | 43.8 | 43.8 |
| REQT. AIR INLET TEMPERATURE | $^{o}C$ | 27.0 | 27.0 | 27.0 |
| REQT. AIR INLET DEW POINT TEMPERATURE | $^{o}C$ | 14.8 | 14.8 | 14.8 |
| REQT. REFRIG. TEMPERATURE BEFORE EXPANSION | $^{o}C$ | 37.8 | 37.8 | 37.8 |
| REQT. MIN. SUBCOOLING BEFORE EXPANSION | $^{o}C$ | 2.8 | 2.8 | 2.8 |
| REQT. REFRIG. OUTLET PRESSURE | kPa | 101.3 | 969 | 903 |
| REQT. REFRIG. OUTLET SUPERHEAT | $^{o}C$ | 5.6 | 5.6 | 5.6 |

FIG. 9

HEAT EXCHANGER ASSEMBLY

The invention generally relates to heat exchanger assemblies, and more particularly relates to features in heat exchangers for reducing the range or a spread of temperature value range across the heat exchanger core.

BACKGROUND OF INVENTION

Due to their high performance, automotive style brazed heat exchangers are being developed for residential air conditioning applications. An example of such a heat exchanger is disclosed in US Patent Application Publication 2009/0173483 by Beamer et al., published Jul. 9, 2009. As shown in FIG. 1, automotive style heat exchangers typically have a pair of headers 22, 24 with a plurality of refrigerant tubes 26 defining fluid passages 28 to provide fluidic communication between the headers 22, 24. The refrigerant tubes 26 extend in a spaced and parallel relationship and are generally perpendicular to the header axes 23 and 25. A pair of core supports 30 are disposed outwards of the refrigerant tubes 26 and extend between the headers 22, 24 in a parallel and spaced relationship to the refrigerant tubes 26. The core supports 30 add structural support to the heat exchanger assembly 20 and protect a plurality of cooling fins 32. The plurality of cooling fins 32 are disposed between adjacent refrigerant tubes 26 and between each core support 30 and the next adjacent of the refrigerant tubes 26 for transferring heat from the refrigerant tubes 26. The plurality of refrigerant tubes 26 and plurality of cooling fins 32 define a heat exchanger core 34.

FIG. 1 illustrates a heat exchanger assembly 20 wherein a refrigerant conduit 36 enters the heat exchanger assembly 20 axially through a header end cap 38. A connector tube 40 is attached to and is in fluidic communication with the refrigerant conduit 36. In heat exchanger assemblies that require the axis of the connector tube to be perpendicular to the header axis 23, the connector tube 40 includes a perpendicular bend external to the header. The refrigerant conduit 36 and connector tube 40 as shown in FIG. 1 may be installed in the inlet header 22. Alternatively the refrigerant conduit 36 and connector tube 40 may be installed the outlet header 24 or both the inlet and the outlet header 22, 24. Those skilled in the art understand that the bend radius of the inlet connector tube 40 is generally limited by the diameter of the tube, the material of the tube and the smoothness inside the connector tube 40 needed to minimize refrigerant pressure difference. As such, the bend radius of the connector tube 40 is often a limiting factor in minimizing the effective length of the connector tube 40 along the header axis 23 or 25 which undesirably affects the length of the inlet and outlet headers 22, 24 as shown below.

In a typical residential air conditioning system, the heat exchanger assembly 20 is positioned in an air duct to direct air flow through the heat exchanger core 34. The length of the headers 22, 24 plus the effective length of the connector tube 40 along the header axis 23 or 25 determines the heat exchanger assembly's packaging width 46, see FIG. 1. The packaging width 46 is limited by the air conditioning system's cabinet width.

Because of the connector tube radius, the length of the headers 22, 24 is limited in order to meet a predetermined packaging width 46. The reduced header length likewise reduces the heat exchanger core width 48, thus reducing the area of the heat exchanger core 34. It would be recognized by those skilled in the art that reducing the heat exchanger core area diminishes heat exchanger assembly performance by reducing the heat capacity of the heat exchanger assembly and increasing the air pressure difference of air flowing through the heat exchanger assembly. Reducing the heat exchanger core width 48 typically requires reducing the number of refrigerant tubes 26 in the heat exchanger core 34. This increases a refrigerant pressure difference between the inlet header 22 and outlet header 24, which is also usually detrimental to heat exchanger performance. Additionally, a blocking baffle 42 may be required within the air duct to prevent air flow directed to the heat exchanger core 34 from bypassing the heat exchanger core 34 and flow through an open area defined by connector tube 40. Therefore, it would be desirable to maximize the heat exchanger core width 48 and minimize the effective length of the connector tube 40.

As disclosed by Beamer, automotive style heat exchangers adapted for residential air conditioning and heat pump applications typically have longer headers 22, 24 than automotive heat exchangers. The increased length has made it more difficult to insert a refrigerant conduit 36 into the header 22, 24 during the manufacturing process. The refrigerant conduit 36 must be properly aligned to prevent damage to the refrigerant conduit 36 or the refrigerant tubes 26. This requires great care on the part of the manufacturing operator or special fixtures to assure proper alignment.

Accordingly, there remains a need for a heat exchanger that is easy to manufacture and provides optimized heat exchanger core area and refrigerant distribution.

SUMMARY OF THE INVENTION

In accordance with one embodiment of this invention, a heat exchanger assembly is provided. The heat exchanger assembly includes an inlet header defining an inlet cavity extending along an inlet header axis. The assembly also includes an outlet header defining an outlet cavity extending along an outlet header axis. The outlet header defines an opening oriented substantially perpendicular to the outlet header axis. The assembly further includes a heat exchanger core including a plurality of refrigerant tubes each extending between the outlet cavity and the inlet cavity. The outlet cavity and inlet cavity are in fluidic communication through the refrigerant tubes. The assembly includes an outlet tube sealably coupled to the opening. The outlet tube and the outlet cavity cooperate to reduce a temperature value range across the heat exchanger core.

In another embodiment of the present invention a heat exchanger assembly is provided. The heat exchanger assembly includes an inlet header defining an inlet cavity extending along an inlet header axis, an outlet header defining an outlet cavity extending along an outlet header axis, and a heat exchanger core including a plurality of refrigerant tubes each extending between the outlet cavity and the inlet cavity. The outlet cavity and inlet cavity are in fluidic communication through the refrigerant tubes. The assembly also includes an inlet conduit sealably engaged with an aperture defined in an inlet header end cap and extending into the inlet cavity.

In yet another embodiment of the present invention a heat exchanger assembly is provided. The heat exchanger assembly includes an inlet header defining an inlet cavity extending along an inlet header axis. The inlet header defines a first opening at a first end of the inlet header. The inlet header further includes an inlet header end cap. The inlet header end cap is sealably engaged within the first opening in order to define an inlet header end cavity outside of the inlet cavity. The assembly also includes an outlet header defining an outlet cavity extending along an outlet header axis. The outlet header defines an opening oriented substantially perpendicular to the outlet header axis. The assembly further includes a heat exchanger core including a plurality of refrigerant tubes each extending along a refrigerant tube axis between the outlet cavity and the inlet cavity. The outlet cavity and inlet cavity are in fluidic communication through the refrigerant tubes. The assembly additionally includes an outlet conduit segregating the outlet cavity into a return region and an outlet region for influencing the flow therebetween. The outlet conduit defines a plurality of outlet orifices that establish fluidic communication between the return region and the outlet region. The assembly also includes an outlet tube sealably coupled to the opening and extending into the outlet region of the outlet cavity, wherein the outlet tube and the outlet region cooperate to reduce a temperature value range across the heat exchanger core. An outlet tube end located within the outlet region defines a sharp edged entrance. The sharp edged entrance induces a pressure difference between the outlet cavity and the outlet tube when refrigerant flows from the outlet cavity into the outlet tube that influences the temperature value range.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

The present invention will now be described, by way of example with reference to the accompanying drawings, in which:

FIG. 9 is a table of the test conditions under which temperature value ranges shown in FIG. 8 were obtained.

DETAILED DESCRIPTION OF INVENTION

Figure 2:
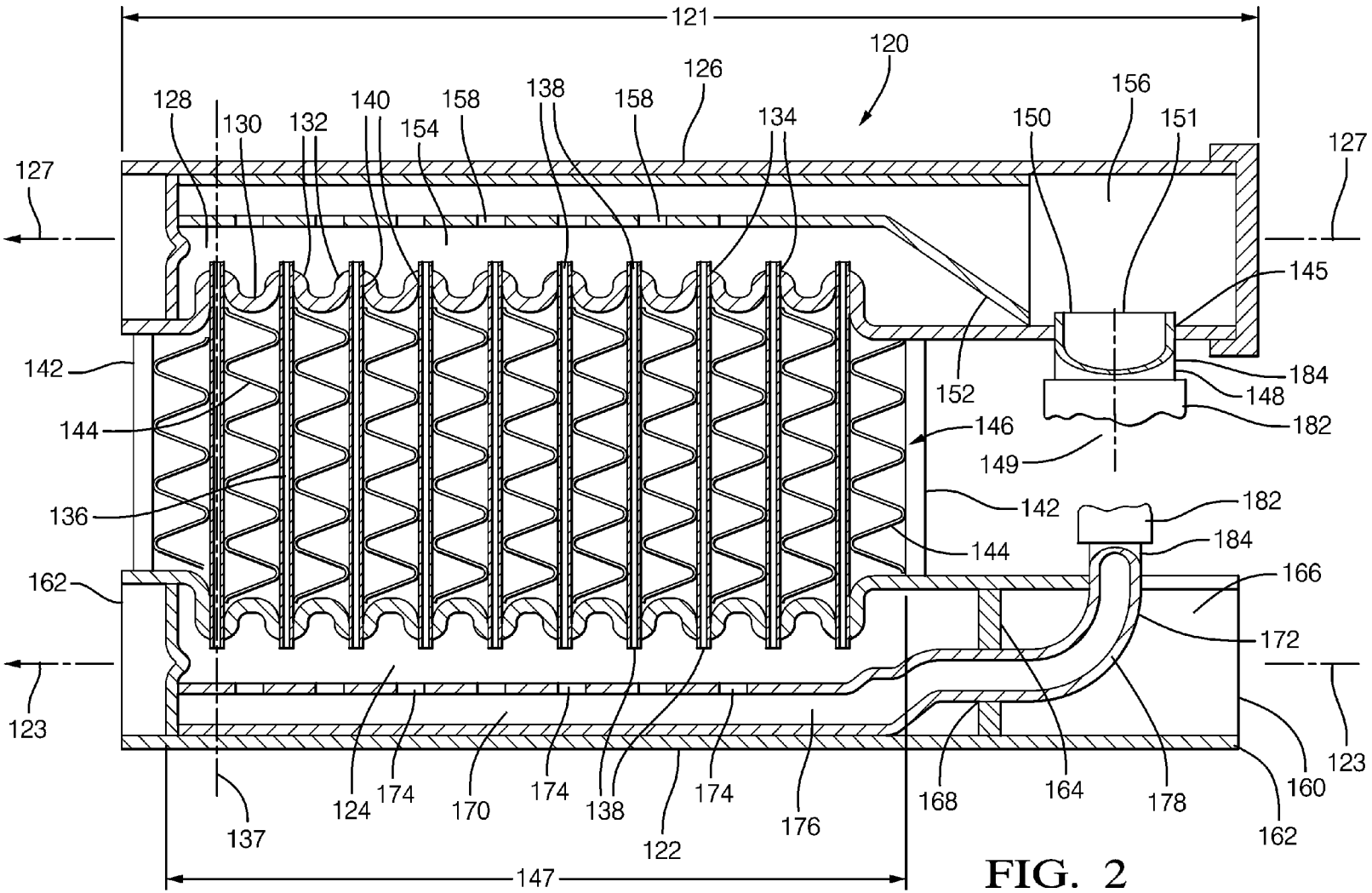
FIG. 2 is a heat exchanger assembly in accordance with one embodiment.

In accordance with an embodiment, FIG. 2 illustrates a heat exchanger assembly 120 comprising an inlet header 122 defining an inlet cavity 124 extending along an inlet header axis 123. An outlet header 126 defines an outlet cavity 128 extending along an outlet header axis 127. The inlet header axis 123 is substantially parallel to the outlet header axis 127. As used herein, substantially parallel typically means within ±15° of absolutely parallel. The inlet header 122 is for receiving a refrigerant for liquid to vapor transformation and the outlet header 126 is for collecting refrigerant vapor. A heat exchanger with this configuration is commonly known as an evaporator. Alternate embodiments can be envisioned where the header 126 is for receiving a refrigerant vapor for vapor to liquid transformation and the header 122 is for collecting refrigerant liquid. A heat exchanger with this configuration is commonly known as a condenser.

Each header 122, 126 includes a lanced surface 130 that is substantially flat and parallel to the corresponding header axis 123, 127. As used herein, substantially flat typically means within ±5 mm of absolutely flat. As shown in FIG. 2, each lanced surface 130 includes a plurality of truncated projections 132 extending into the corresponding cavity 124, 128 and being axially spaced from one another to define valleys between adjacent truncated projections 132 and defining a plurality of header slots 134 extending substantially perpendicular to the header axes 123, 127.

A heat exchanger core 146 includes a plurality of refrigerant tubes 136 each extend along a refrigerant tube axis 137 in a spaced and parallel relationship between the outlet cavity 128 and the inlet cavity 124. The outlet cavity 128 and inlet cavity 124 are in fluidic communication through the refrigerant tubes 136. Each of the refrigerant tubes 136 defines a fluid passage 138 extending between the refrigerant tube ends 140. Each fluid passage 138 is in fluidic communication with the inlet cavity 124 and outlet cavity 128 for transferring refrigerant vapor from the inlet cavity 124 to the outlet cavity 128. The refrigerant tube ends 140 generally extend through one of the header slots 134 of each of the headers 122, 126 and into the corresponding cavity 124, 128.

A pair of core supports 142 are disposed outwards of the refrigerant tubes 136 and extend between the headers 122, 126 in a parallel and spaced relationship to the refrigerant tubes 136. The core supports 142 add structural support to the heat exchanger assembly 120 and protect a plurality of cooling fins 144. The core supports 142 and the headers 122, 126 define an outer edge of the heat exchanger core 146.

The heat exchanger core 146 also includes a plurality of cooling fins 144 disposed between adjacent refrigerant tubes 136 and between each core support 142 and the next adjacent of the refrigerant tubes 136. The cooling fins 144 may be serpentine fins or any other cooling fin type commonly known in the art.

In this non-limiting example, the outlet header 126 defines an opening 145 oriented substantially perpendicular to the outlet header axis 127. As used herein, substantially perpendicular typically means within ±15° of absolutely perpendicular. An outlet tube 148 is sealably coupled to this opening 145 and is illustrated as being substantially perpendicular to the outlet header 126. In contrast to FIG. 1, the outlet tube 148 does not extend beyond an end of the outlet header 126. Therefore, with respect to the outlet tube 148, the packaging width 121 of the heat exchanger assembly 120 is generally equal to the length of the outlet header 126. As will be described in more detail below, the outlet tube 148 and the outlet cavity 128 cooperate to reduce a temperature value range across the heat exchanger core 146. As used herein, the temperature value range is the difference between highest temperature value and the lowest temperature value measured on the surface of the heat exchanger core.

The opening 145 defines a sharp edged entrance 150 that is substantially perpendicular to the outlet header axis 127. It has been observed that the refrigerant flowing from the outlet cavity 128 and flowing into the sharp edged entrance 150 induces a pressure difference between the outlet region 156 and the outlet tube 148 that influences the temperature value range.

The sharp edged entrance 150 may be characterized as having a flow resistance coefficient, also known in the art as a K factor, greater than 1 because it is perpendicular to the refrigerant flow in the outlet region 156. For the purpose of comparison, a sharp edged entrance having an axial orientation to the refrigerant flow may be characterized as having a flow resistance coefficient of about 0.75. As such, it is expected that the perpendicular outlet configuration of heat exchanger assembly 120 will exhibit a larger pressure difference than an axial outlet configuration found in prior art heat exchanger assemblies.

Figure 3:
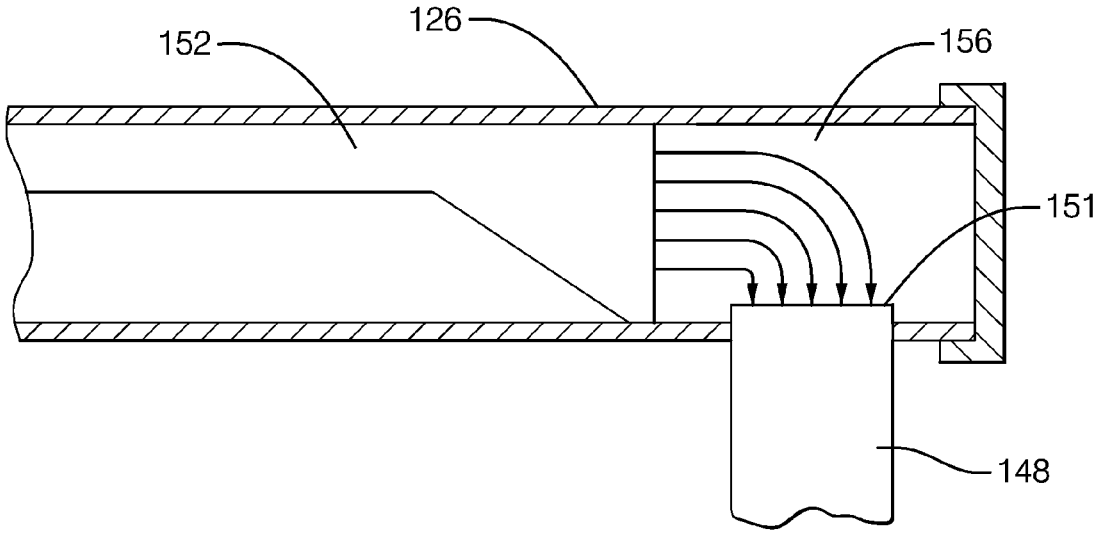
FIG. 3 is a diagram showing an idealized refrigerant flow between an outlet header and an outlet tube in accordance with one embodiment.

FIG. 3 illustrates an idealized refrigerant flow between the outlet cavity 128 and the outlet tube 148. In general, flow paths illustrated as having curves with a relatively small radius are expected to identify regions that may exhibit relatively higher pressure differences.

By way of example, and not limitation, the pressure difference between the outlet cavity and the outlet tube is greater than 15.2 kilopascals (2.2 pounds-force per square inch) gauge at a local velocity of about 10 meters per second (1985 feet per minute). In another non-limiting example, the pressure difference between the outlet header 126 and outlet tube 148 may be about 17.2 kilopascals (2.5 pounds-force per square inch) gauge with a corresponding mass flow rate of about 4.7 kilograms per minute (10.3 pounds-mass per minute) for R-410a refrigerant and a corresponding outlet header 126 cross sectional area of about 572.6 square millimeters and a corresponding outlet tube 148 cross sectional area of about 194.8 square millimeters.

As illustrated in FIG. 2, the heat exchanger assembly 120 may also include an outlet conduit 152 inserted into the outlet cavity 128, segregating the outlet cavity 128 into a return region 154 and an outlet region 156. In general, the outlet conduit 152 influences the refrigerant flow distribution between the return region 154 and the outlet region 156. In this non-limiting example, the outlet conduit 152 is substantially parallel to the outlet header axis 127. The outlet conduit 152 may include a plurality of outlet orifices 158 that establish fluidic communication between the return region 154 and the outlet region 156. The outlet conduit 152 may be configured to decrease a pressure difference along the outlet conduit 152 to provide more uniform refrigerant distribution along the length of the outlet conduit 152.

Also illustrated in FIG. 2, the outlet tube 148 may extend into the outlet cavity 128. As such, the sharp edged entrance 150 may be defined by an outlet tube end 151 located within the outlet region 156. This embodiment may be preferred since it does not require the outlet tube end 151 to be shaped to match the exterior contour of the outlet header 126 as is needed when the outlet tube does not extend into the outlet region but is positioned flush with the inner surface of the outlet header. As a flush arrangement may require special fixtures when assembling the outlet tube 148 to the outlet header 126, the arrangement illustrated in FIG. 2 may be advantageous as it may not require special fixtures for attaching the outlet tube 148 to the outlet header 126 during the manufacturing process.

As illustrated in FIG. 2, the inlet header 122 may define a first opening 160 at a first end 162 of the inlet header 122. In this embodiment, the inlet header 122 may include an inlet header end cap 164. The inlet header end cap 164 may be sealably engaged within the first opening 160 in order to define an inlet header end cavity 166 outside of the inlet cavity 124. This inlet header end cap 164 may define an aperture 168.

As illustrated in the non-limiting example shown in FIG. 2, the heat exchanger assembly 120 may also include an inlet conduit 170 that is disposed in the inlet cavity 124. The inlet conduit 170 is substantially parallel to the inlet header axis 123. The aperture 168 is generally configured to allow passage of the inlet conduit 170 through the inlet header end cap 164. The aperture 168 in the inlet header end cap 164 is sealably engaged with the inlet conduit 170. The inlet header end cap 164 segregates an inlet end 172 portion of the inlet conduit 170. The inlet conduit 170 may include a plurality of inlet orifices 175 that establish fluidic communication between the inlet cavity 124 and an inlet region 176 within the inlet conduit 170. The inlet conduit 170 and the inlet cavity 124 cooperate to reduce a temperature value range across the heat exchanger core.

Figure 4:
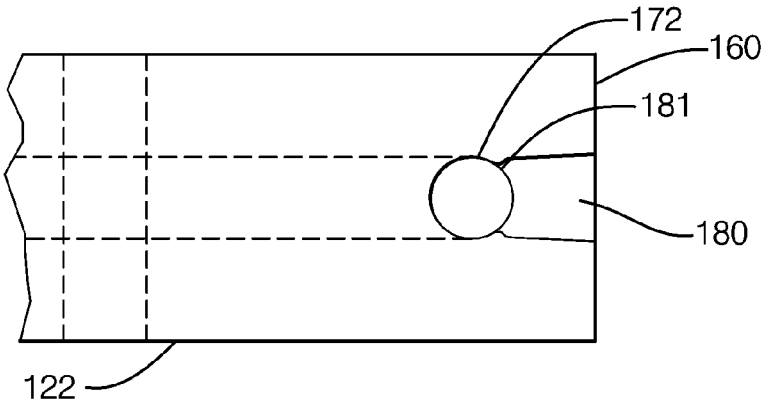
FIG. 4 is a detailed view of an inlet end of an inlet conduit in an alignment slot in accordance with one embodiment.

As illustrated in FIG. 2, the inlet end 172 is external to the inlet cavity 124. The inlet end 172 may be coupled to the inlet orifices by a bend 178 that orients the inlet conduit 170 substantially perpendicular to the inlet header axis 123. As illustrated in FIG. 3, an alignment slot 180 defined by the inlet header end cavity 166 may be configured to receive the inlet end 172 to align the inlet end 172 in the inlet header end cavity 166. The inlet end 172 is preferably configured so that it does not extend beyond the first end 162 of the inlet header 122. Therefore, with respect to the inlet conduit 170, the packaging width 121 of the heat exchanger assembly 120 is generally equal to the length of the inlet header 122. FIG. 4 illustrates a non-limiting example of the inlet end 172 situated within the alignment slot 180 in the inlet header 122 and substantially perpendicular to inlet header axis 123. FIG. 4 also illustrates that the inlet end 172 may be configured so that is does not extend beyond first end 162 of the inlet header 122.

As illustrated in FIG. 2, the outlet tube 148 may extend along an outlet tube axis 149. The outlet tube axis 149 and the refrigerant tube axis 137 are substantially parallel and the outlet tube 148 is generally adjacent one of the pair of core supports 142. Likewise, the inlet end 172 extends along an inlet header axis 123. The inlet header axis 123 and the refrigerant tube axis 137 are substantially parallel and the inlet end 172 is generally adjacent one of the pair of core supports 142.

Continuing to refer to FIG. 2, the heat exchanger assembly 120 may also include a connector tube 182 that may be coupled to the end of the outlet tube 148 or inlet conduit 170 to facilitate joining refrigerant plumbing from an air conditioner assembly to the heat exchanger assembly 120, especially if the outlet tube 148 or inlet conduit 170 material and refrigerant plumbing materials are dissimilar materials, such as aluminum and copper. In applications where dissimilar materials are used, an encapsulant 184 may be disposed about the outlet tube 148 or inlet conduit 170 and the connector tube 182 for shielding these elements from corrosion. However, those skilled in the art appreciate an encapsulant may be included in additional embodiments of the heat exchanger assembly 120.

Figure 1:
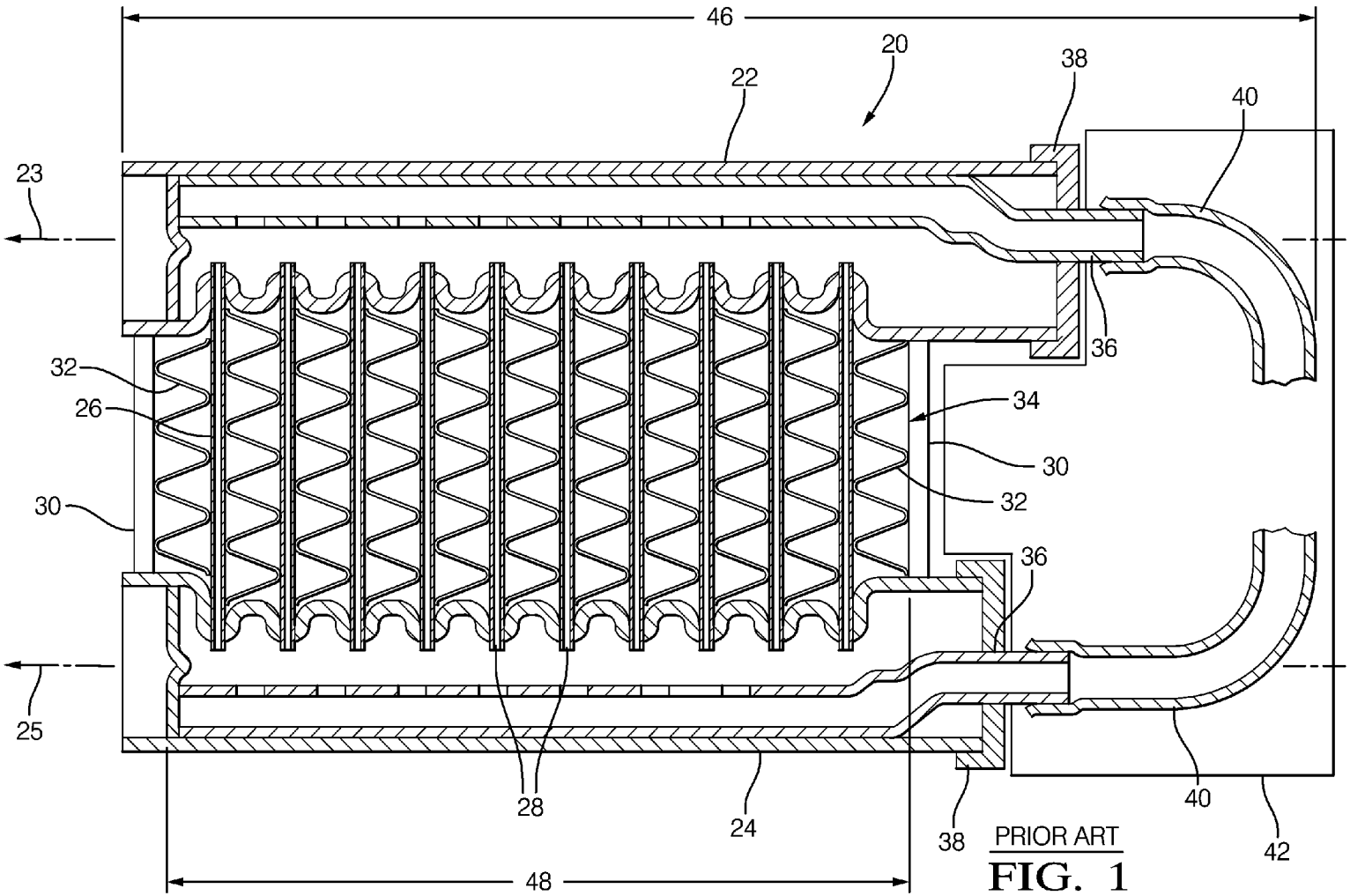
PRIOR ART FIG. 1
FIG. 1 is a prior art heat exchanger assembly having axial connector tubes.

Because the heat exchanger assembly 120 may be configured such that the outlet tube 148 and inlet conduit 170 do not extend beyond the ends of the headers 122, 126, the packaging width 121 of the heat exchanger assembly 120 is generally equivalent to the longer of the axial length of the inlet header 122 or outlet header 126. For a given packaging width 121, the headers 122, 126 of heat exchanger assembly 120 can be wider compared to a heat exchanger assembly with similar packaging width having axial inlet and outlet tubes as shown in FIG. 1, hereafter referred to as an axial heat exchanger assembly, due to the bend radii of the connector tubes. The additional length of the headers 122, 126 allow the heat exchanger assembly 120 to have additional refrigerant tubes 136 and cooling fins 144, increasing the heat exchanger core width 147 and therefore increasing the area of the heat exchanger core compared to the axial heat exchanger assembly.

A blocking baffle may be used to prevent airflow in the duct from bypassing the heat exchanger core 146 because it flows through the open area defined by the inlet end 172 and outlet tube 148 when the heat exchanger assembly 120 is located in an air duct in an air conditioner assembly. Increasing the heat exchanger core width 147 may reduce the size of a blocking baffle needed or may eliminate the need for a blocking baffle.

An advantage of the increased heat exchanger core area generally is that it generally decreases the air pressure difference through the heat exchanger core 146 at a given airflow volume through the heat exchanger assembly 120 when compared to the axial heat exchanger assembly shown in FIG. 1. An air conditioning system typically uses a fan or other airflow induction system to generate the pressure difference through the heat exchanger. The power required for such an airflow induction system is ideally expressed as $P=dp\times q$ where P is the power, dp is the pressure difference, and q is the airflow volume. Therefore, when the air pressure difference through the heat exchanger core 146 is reduced, the power of the air induction system may be reduced and still maintain the same airflow volume through the heat exchanger assembly 120 as the axial heat exchanger assembly. A reduced power airflow induction system would likely have the advantages of lower procurement costs and operating costs.

Figure 5:
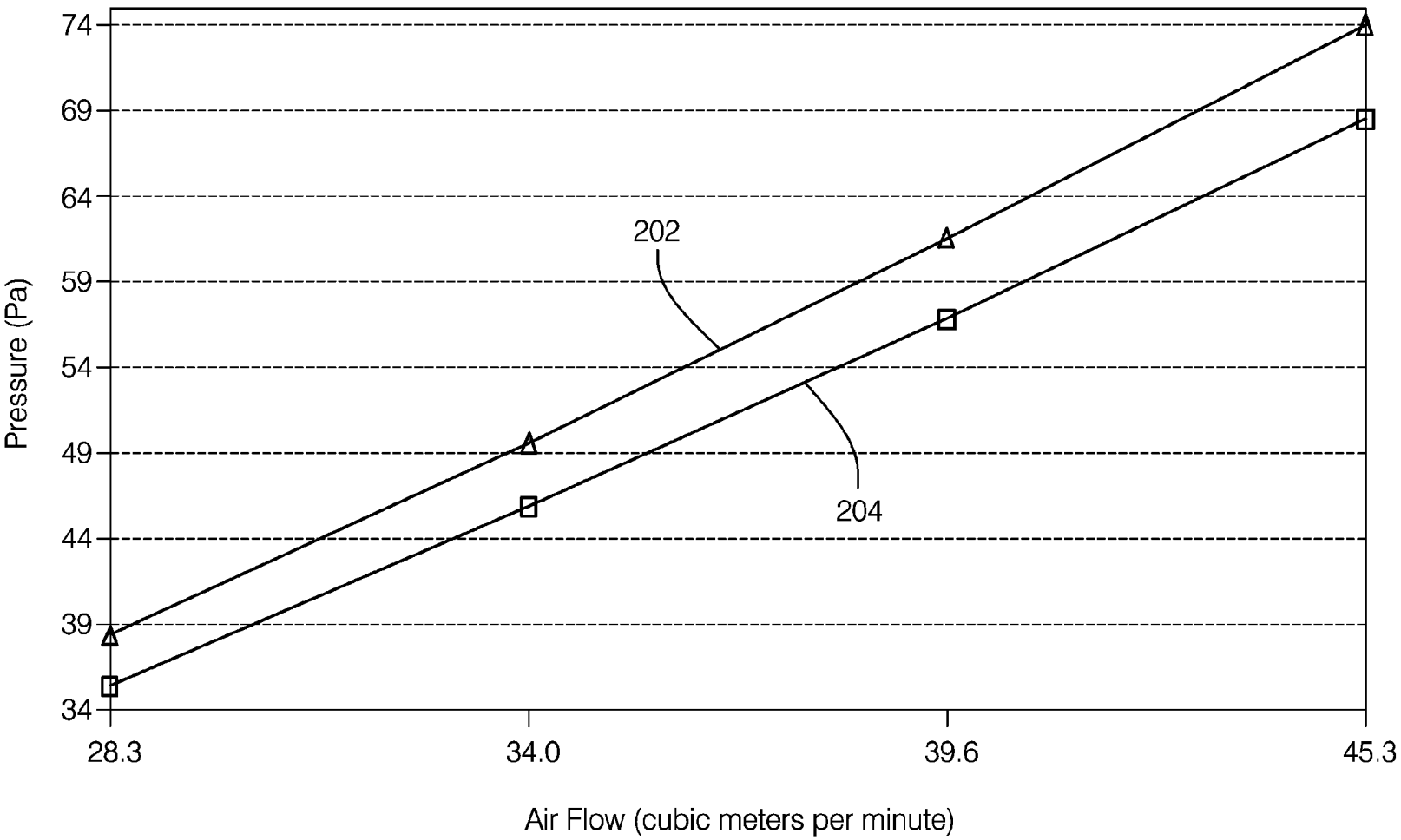
FIG. 5 is a graph showing a comparison of the air pressure difference of an embodiment of the heat exchanger assembly and a prior art heat exchanger assembly having axial connector tubes.

FIG. 5 shows data generated by a computer simulation that illustrates the reduced pressure difference of airflow through the heat exchanger assembly 120 compared with the axial heat exchanger assembly. This computer simulation has historically shown good correlation to actual test results. The pressure difference data indicated by the upper curve 202 is derived from a computer model of a heat exchanger assembly similar to that shown in FIG. 1. The pressure difference data indicated by the lower curve 204 is derived from a computer model a heat exchanger assembly similar to that shown in FIG. 2. The pressure difference is shown in pressure units of Pascals over an airflow volume range of 28.3 to 45.3 cubic meters per minute.

The heat capacity Q is the rate of heat energy dissipation from a heat exchanger. The heat capacity of a heat exchanger can generally be increased by adding additional refrigerant tubes 136 and cooling fins 144 to increase the amount of refrigerant flowing through the heat exchanger core 146 or equalizing refrigerant distribution between refrigerant tubes 136 so that each refrigerant tube 136 and cooling fin 144 is dissipating a generally equal amount of heat. Heat capacity can also be increased by increasing the airflow volume through the heat exchanger core 146.

For a predetermined packaging width 121, the configuration of the heat exchanger assembly 120 is such that the length of the headers 122, 126 may be increased for a predetermined packaging width 121 because the outlet tube 148 and inlet end 172 may exit the headers 122, 126 perpendicularly rather than axially, thereby allowing for increasing the heat exchanger core width 147. The increased heat exchanger core width 147 allows additional refrigerant tubes 136 to be included in the heat exchanger core 146. The additional refrigerant tubes 136 and cooling fins 144 allowed by the increased length of the headers 122, 126 increases the heat capacity of heat exchanger assembly 120 compared with the axial heat exchanger assembly by generally allowing additional refrigerant to flow through the additional refrigerant tubes 136 allowing additional heat energy dissipation by the additional cooling fins 144.

Figure 6:
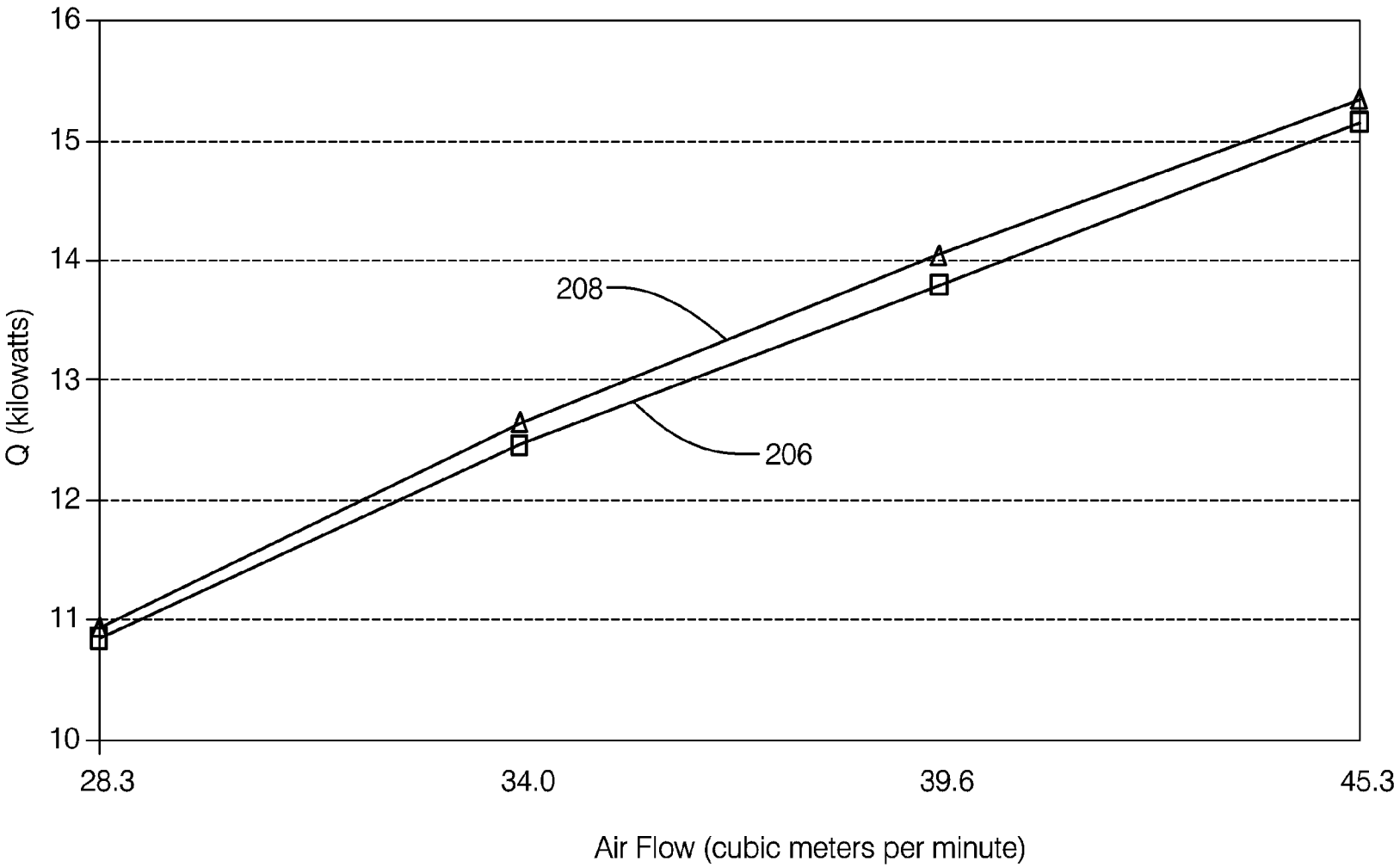
FIG. 6 is a graph showing a comparison of the heat capacity of an embodiment of the heat exchanger assembly and a prior art heat exchanger assembly having axial connector tubes.

FIG. 6 shows data generated by a computer simulation that illustrates the increased heat capacity Q of the heat exchanger assembly 120 compared with the axial heat exchanger assembly. This computer simulation has historically shown good correlation to actual test results. The heat capacity data indicated by the lower curve 206 is derived from a computer model of a heat exchanger assembly similar to that shown in FIG. 1. The heat capacity data indicated by the upper curve 208 is derived from a computer model of a heat exchanger assembly similar to that shown in FIG. 2. The heat capacity is shown in units of kilowatts over an airflow volume range of 28.3 to 45.3 cubic meters per minute.

The addition of refrigerant tubes 136 to the heat exchanger assembly 120 also generally serves to lower the pressure difference between the headers 122, 126 compared to the axial heat exchanger assembly. However, the heat exchanger assembly 120 generally has a larger pressure difference between the outlet cavity 128 and the outlet tube 148 than the axial heat exchanger assembly. The net result may be an increased pressure difference between the headers 122, 126 in heat exchanger assembly 120 compared to the axial heat exchanger assembly.

Figure 7:
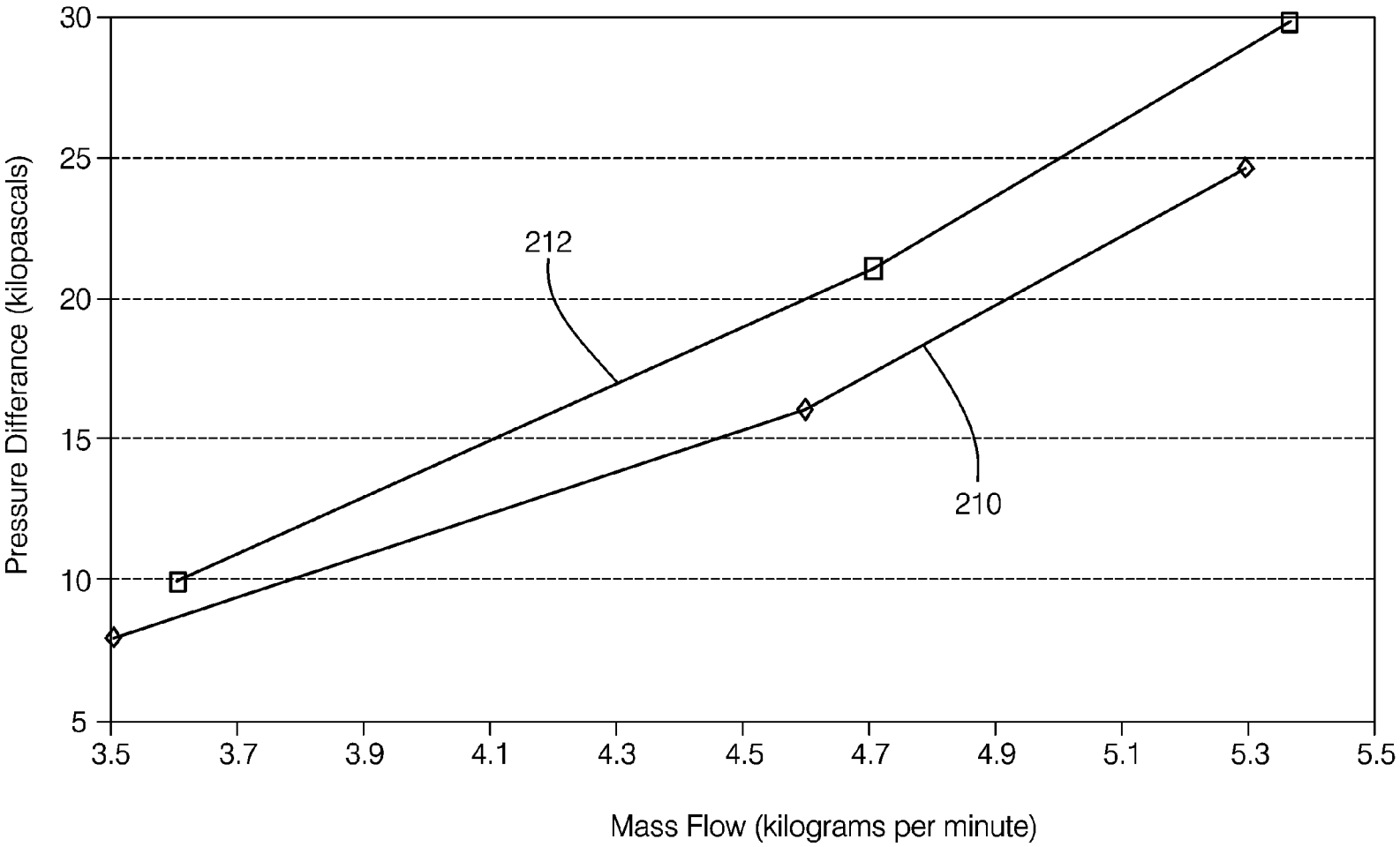
FIG. 7 is a graph showing a comparison of the inlet to outlet header pressure difference of an embodiment of the heat exchanger assembly and a prior art heat exchanger assembly having axial connector tubes.

FIG. 7 shows experimental test data that illustrates the increased refrigerant pressure difference of the heat exchanger assembly 120 compared with the axial heat exchanger assembly. The pressure difference data indicated by the lower curve 210 is from a heat exchanger assembly similar to that shown in FIG. 1. The pressure difference data indicated by the upper curve 212 is from a heat exchanger assembly similar to that shown in FIG. 2. The pressure difference is shown in units of kilopascals (gauge) over a mass flow range of 3.5 to 5.5 kilograms of R-410a refrigerant per minute.

It was expected that the arrangement of the outlet cavity 128 and the outlet tube 148 may increase the pressure difference between the outlet cavity 128 and the outlet tube 148. Without subscribing to any particular theory, it is believed that the increased pressure difference between the outlet cavity 128 and the outlet tube 148 in heat exchanger assembly 120 influences the temperature value range. Therefore, features that influence pressure difference may be varied in order to decrease the temperature value range and thereby provide for more uniform distribution of the refrigerant flow through the refrigerant tubes 136. The reduced temperature value range may also contribute to increased heat capacity, since each of the refrigerant tubes 136 may be contributing more equally to the heat exchanger assembly's energy dissipation.

Figure 8:
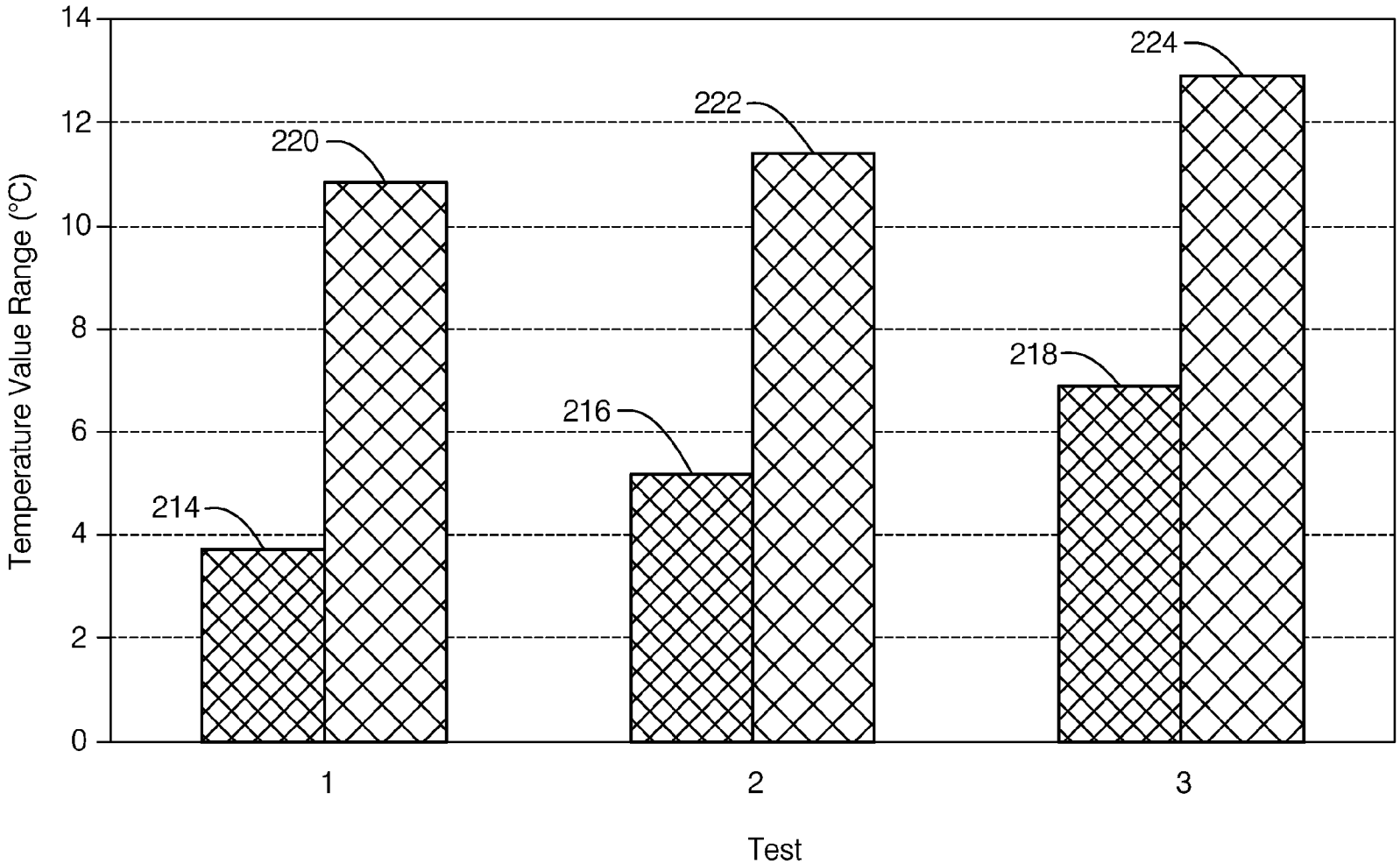
FIG. 8 is a graph showing a comparison of the temperature value range of an embodiment of the heat exchanger assembly and a prior art heat exchanger assembly having axial connector tubes.

FIG. 8 shows experimental test data that illustrates a comparison of the temperature value range of the heat exchanger assembly 120 compared with the axial heat exchanger assembly during three different test conditions. The bar graphs 214, 216, and 218 indicate the temperature value range observed of a heat exchanger assembly similar to that shown in FIG. 2. The bar graphs 220, 222, and 224 indicate the temperature value range observed of a heat exchanger assembly similar to that shown in FIG. 1. The temperature value range is shown in units of degrees Celsius. The parameters and values for the three test conditions are shown in FIG. 9.

Figure 10:
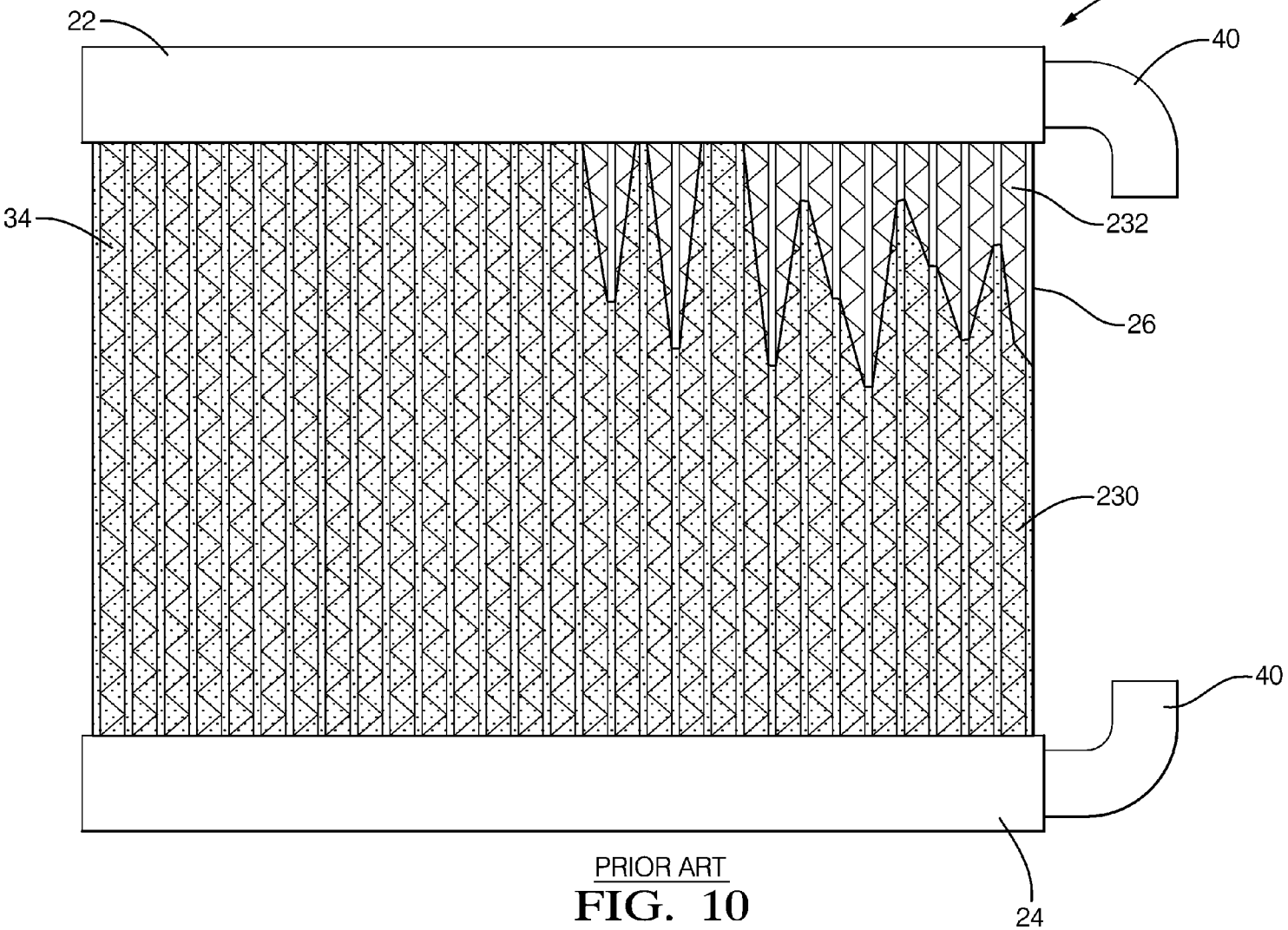
PRIOR ART FIG. 10
FIG. 10 illustrates a thermal image of the heat exchanger core of a prior art heat exchanger assembly having axial connector tubes.

FIG. 10 shows test data that illustrates a thermo-graphic image of the heat exchanger core of a heat exchanger assembly 20 similar to that shown in FIG. 1. The heat exchanger assembly 20 includes an outlet header 22, an inlet header 24, and a plurality of refrigerant tubes 26 in hydraulic communications with both headers 22, 24. A two phase refrigerant is distributed to the refrigerant tubes 26 extending from the inlet header 24 to the outlet header 22. As the two phase refrigerant flows through the refrigerant tubes 26 to the outlet header 22, the liquid phase changes to gas phase by the absorption of heat from the ambient air. The shaded areas 230 of the thermo-graphic image represents the liquid/gaseous phase region within the refrigerant tubes 26 and the unshaded areas 232 represent the gas phase region of the refrigerant. The gas phase of the refrigerant is collected in the outlet header 22. Due to the heat of vaporization, the amount of heat absorbed by the refrigerant during the liquid to gaseous phase change is greater than the amount of heat absorbed by the refrigerant after it is in the gaseous phase. If refrigerant distribution is not equalized between refrigerant tubes, the refrigerant in some refrigerant tubes may change to the gaseous phase too quickly, decreasing their ability to absorb heat. This may lower the heat capacity of the heat exchanger assembly. A heat exchanger core with ideal refrigerant distribution is generally indicated in a thermo-graphic image by the shaded regions being substantially level. As seen in FIG. 10, an unshaded area in the upper right corner of the image indicates sub-optimum refrigerant distribution to the refrigerant tubes on the right side of the heat exchanger assembly 20.

Figure 11:
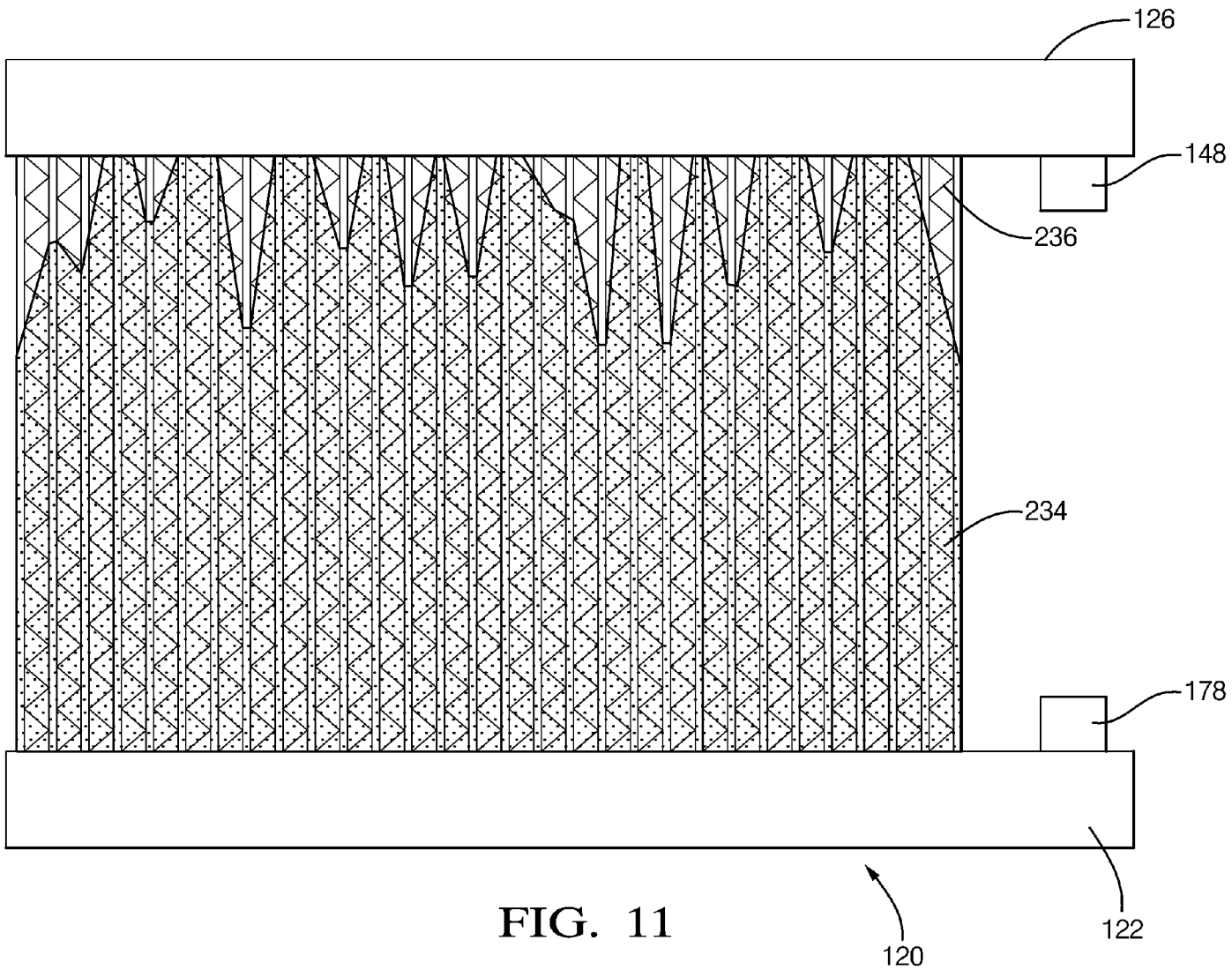
FIG. 11 illustrates a thermal image of the heat exchanger core of an embodiment of the heat exchanger assembly.

FIG. 11 shows test data that illustrates a thermo-graphic image of the heat exchanger core of a heat exchanger assembly 120 similar to that shown in FIG. 2. The shaded areas 234 of the image in FIG. 11 are more level than the shaded areas 230 shown in FIG. 10, indicating more even refrigerant distribution between the refrigerant tubes 136 in the heat exchanger assembly 120 and thus increased heat capacity for the heat exchanger assembly 120 compared to the heat exchanger assembly 20.

The reduced temperature value range was unexpected because it was believed that any performance improvements in the heat exchanger assembly 120 would arise solely from additional refrigerant tubes 136 and increased heat exchanger core area. Prior art solutions for equalizing refrigerant distribution among the refrigerant tubes were directed toward decreasing the pressure difference along the outlet header, for example as disclosed by Beamer. In contrast, the arrangement presented herein increased the pressure difference between the outlet cavity 128 and the outlet tube 148 along the outlet header 126.

Increasing the heat exchanger core width 147 also increases the inlet header length. Increasing the inlet header length may make it difficult to install the inlet conduit 170 in the inlet header during the manufacturing process without damaging the inlet conduit 170 or the refrigerant tubes 136. The inlet conduit 170 must be properly aligned in the inlet header 122 to ensure that it does not contact the refrigerant tube ends 140 as it is inserted into the inlet header 122. As the inlet conduit 170 is inserted into the inlet header 122 during the manufacturing process, the inlet end 172 is aligned with the alignment slot 180. The inlet end 172 cooperates with the alignment slot 180 and the inlet header end cap 164 to ensure that the inlet conduit 170 is in the proper location in the inlet header 122. A snap feature 181 captures the inlet end 172 when it is fully inserted in the alignment slot 180 and holds it in place.

Accordingly, a heat exchanger assembly 120 comprised of an outlet header 126 with an outlet tube 148, an inlet header 122 with an inlet end 172, and a heat exchanger core 146 is provided. The embodiments presented provide a reduced temperature value range across the heat exchanger core 146 compared to heat exchanger assemblies with a similar packaging width 121 having axial inlet and outlet tubes. The reduced temperature value range may be an indicator of more uniform refrigerant distribution between the refrigerant tubes 136 within the heat exchanger core 146. For a predetermined packaging width 121, the configuration of the heat exchanger assembly 120 is such that the length of the headers 122, 126 may be increased for a predetermined packaging width 121 because the outlet tube 148 and inlet end 172 may exit the headers 122, 126 perpendicularly rather than axially, thereby allowing for increasing the heat exchanger core width 147. The increased heat exchanger core width 147 allows additional refrigerant tubes 136 to be included in the heat exchanger core 146, providing for increased airflow volume at the same air pressure difference for air flowing through the heat exchanger assembly 120 and so increased heat exchanger assembly heat capacity.

While this invention has been described in terms of the preferred embodiments thereof, it is not intended to be so limited, but rather only to the extent set forth in the claims that follow.

We claim:

1. A heat exchanger assembly, comprising:

an inlet header defining an inlet cavity extending along an inlet header axis, wherein the inlet header defines a first opening at a first end of the inlet header, wherein said inlet header further comprises an inlet header end cap, wherein the inlet header end cap is sealably engaged within the first opening in order to define an inlet header end cavity outside of the inlet cavity;

an outlet header defining an outlet cavity extending along an outlet header axis, wherein the outlet header defines an opening oriented substantially perpendicular to the outlet header axis;

a heat exchanger core including a plurality of refrigerant tubes each extending along a refrigerant tube axis between the outlet cavity and the inlet cavity, wherein the outlet cavity and the inlet cavity are in fluidic communication through the plurality of refrigerant tubes;

an outlet conduit segregating the outlet cavity into a return region and an outlet region for influencing a flow therebetween, wherein the outlet conduit defines a plurality of outlet orifices that establish fluidic communication between the return region and the outlet region; and an outlet tube sealably coupled to said opening and extending into the outlet region of the outlet cavity, wherein the outlet tube and the outlet region cooperate to reduce a temperature value range across the heat exchanger core, wherein an outlet tube end located within the outlet region defines a sharp edged entrance, wherein the sharp edged entrance induces a pressure difference between the outlet cavity and the outlet tube when refrigerant flows from the outlet cavity into the outlet tube that influences the temperature value range.

2. The heat exchanger assembly in accordance with claim 1, wherein the assembly further comprises an inlet conduit sealably engaged with an aperture defined in the inlet header end cap and extending into the inlet cavity, wherein said inlet conduit defines a plurality of orifices that establish fluidic communication between said inlet cavity and an inlet region within the inlet conduit, wherein an inlet end of the inlet conduit external to the inlet cavity is coupled to the plurality of orifices by a bend that orients the inlet end substantially perpendicular to the inlet header axis; and an alignment slot defined by the inlet header end cavity configured to receive said inlet end to align the inlet end.

3. The heat exchanger assembly in accordance with claim 1, wherein the assembly further comprises a pair of core supports disposed outwards of the plurality of refrigerant tubes and extending between said outlet header and said inlet header in a parallel and spaced relationship to said plurality of refrigerant tubes, wherein said outlet tube extends along an outlet tube axis, wherein the outlet tube axis and the refrigerant tube axis are substantially parallel and the outlet tube is generally adjacent one of the pair of core supports, wherein an inlet end extends along a inlet axis, wherein the inlet axis and the refrigerant tube axis are substantially parallel and the inlet end is generally adjacent one of the pair of core supports.

4. The heat exchanger assembly in accordance with claim 1, wherein said sharp edged entrance of the outlet tube has a flow resistance coefficient greater than 1.

5. The heat exchanger assembly in accordance with claim 1, wherein the pressure difference between the outlet cavity and the outlet tube is greater than 15.2 kilopascals gauge at a local velocity of about 10 meters per second.

6. A heat exchanger assembly, comprising:

an inlet header defining an inlet cavity extending along an inlet header axis;

an outlet header defining an outlet cavity extending along an outlet header axis, wherein the outlet header defines an opening oriented substantially perpendicular to the outlet header axis;

a heat exchanger core including a plurality of refrigerant tubes each extending between the outlet cavity and the inlet cavity, wherein the outlet cavity and the inlet cavity are in fluidic communication through the plurality of refrigerant tubes; and an outlet tube sealably coupled to said opening, wherein the outlet tube and the outlet cavity cooperate to reduce a temperature value range across the heat exchanger core, wherein said opening defines a sharp edged entrance, wherein the sharp edged entrance induces a pressure difference between the outlet cavity and the outlet tube when refrigerant flows from the outlet cavity into the outlet tube that influences the temperature value range, wherein an outlet header cross sectional area is about 572.6 square millimeters and an outlet tube cross sectional area is about 194.8 square millimeters and the pressure difference between the outlet header and the outlet tube is about 17.2 kilopascals gauge at a mass flow rate of 4.7 kilograms per minute.

* * * * *